US005724635A

United States Patent [19]

Nagaoka et al.

[11] Patent Number: 5,724,635

[45] Date of Patent: Mar. 3, 1998

[54] DEVELOPING DEVICE AND IMAGE FORMING APPARATUS USING THE DEVELOPING DEVICE

[75] Inventors: Shigeki Nagaoka; Hidenori Fujioka, both of Hyogo, Japan

[73] Assignee: Fujitsu Limited, Kawasaki, Japan

[21] Appl. No.: 822,761

[22] Filed: Mar. 24, 1997

Related U.S. Application Data

[63] Continuation of Ser. No. 429,772, Apr. 27, 1995, abandoned.

[30] Foreign Application Priority Data

Jul. 7, 1994 [JP] Japan ..... 6-156234
Feb. 21, 1995 [JP] Japan ..... 7-032694

[51] Int. Cl.[6] ..... G03G 15/08

[52] U.S. Cl. ..... 399/260; 399/258; 399/262

[58] Field of Search ..... 399/119, 258, 399/260, 262–263; 222/DIG. 1

[56] References Cited

U.S. PATENT DOCUMENTS 3,664,299 5/1972 Shaler et al. ..... 118/656
4,711,551 12/1987 Fujio et al. ..... 118/653 X
4,723,143 2/1988 Enomoto ..... 118/657 X
4,800,412 1/1989 Ueda ..... 118/658 X
4,855,783 8/1989 Takashima et al. ..... 355/245 X
4,862,213 8/1989 Ichihara et al. ..... 355/245
4,967,691 11/1990 Chikawa et al. ..... 118/656
5,016,053 5/1991 Ibuchi et al. ..... 355/245
5,036,364 7/1991 Murasawa ..... 355/251
5,187,523 2/1993 Osawa ..... 355/251
5,617,192 4/1997 Tonomoto et al. ..... 399/263
5,629,759 5/1997 Jyoroku ..... 399/262
5,652,944 7/1997 Masuda et al. ..... 399/24

*Primary Examiner*—Matthew S. Smith
*Attorney, Agent, or Firm*—Armstrong, Westerman Hattori, McLeland & Naughton

[57] ABSTRACT

A developing device for use in an image forming apparatus, the developing device including a dispersion-preventing plate extending from an outlet of a toner hopper near to an upper portion of a stirrer, and/or a stirrer provided with blades radially fixed to its rotary axis and spiral screws alternately in the axis direction.

56 Claims, 10 Drawing Sheets

DEVELOPING DEVICE AND IMAGE FORMING APPARATUS USING THE DEVELOPING DEVICE

This application is Continuation of application Ser. No. 08/429,772 filed Apr. 27, 1995, now abandoned.

BACKGROUND OF THE INVENTION

1. Field of the Invention

The present invention relates to an image forming apparatus such as a copying machine, a facsimile machine, and a printing machine and to a developing device used therein.

2. Description of the Related Art

An image forming apparatus such as a copying machine, a facsimile machine, and a printing machine provides, an image through an exposing process for forming a desired electrostatic latent image on the surface of a photosensitive drum, a developing process for developing the obtained latent image by making toner adhere thereto, a transferring process for transferring the toner image onto a predetermined transfer paper, and a fixing process for fixing the transferred toner image by heating it. The process of exposing, developing and transferring are successively performed by the respective devices provided around the photosensitive drum in accordance with the rotation of the photosensitive drum.

FIG. 1 is a side sectional view showing a configuration of a conventional developing device used in the aforementioned image forming apparatus. As shown in the figure, in the developing device, one side of a housing 11 faces the outer periphery of a photosensitive drum 10 shown by a two-dot chain line, and the other end of the housing 11 is provided with a toner hopper 6 which holds toner T for developing. In the housing 11, a developing roller 5 is provided with one end thereof adjacent and facing to the drum 10, and a developer circulating chamber 1, surrounded by the housing 11, is provided at the other end of the developing roller 5. In the circulating chamber 1, a stirrer 12 is provided under the fixing position of the toner hopper 6. A pair of transferring screws 13 and 14 are provided between the developing roller 5 and the stirrer 12. A sufficient amount of developer 7 covers a large part of the stirrer 12 and screws 13 and 14 housed in the circulating chamber 1.

The developing roller 5 is a well-known magnetic roller obtained by arranging a plurality of stationary magnets inside the nonmagnetic outer cylinder in the peripheral direction. The outer cylinder of the developing roller 5 rotates in the same direction as that of the drum 10 around the axis parallel with that of the drum 10. The stirrer 12 and the transferring screws 13 and 14 rotate around the respective axes parallel with that of the drum 10.

The toner hopper 6 is provided with an outlet 60 opening downward in the housing 11 and the outlet 60 is provided with a supply roller 61. The supply roller 61 is a sponge roller rotatable around its horizontal axis. The toner T housed in the toner hopper 6 adheres to the outer periphery of the supply roller 61, and a proper quantity is drawn from the outlet 60 to be supplied onto the stirrer 12 in the circulating chamber 1 in accordance with the rotation of the supply roller 61.

The stirrer 12 is provided with a plurality of blades 12*a* (whose number is optional: four blades in the illustrated embodiment) radially projecting toward the outside of the axis of rotation. The toner T supplied from the outlet 60 of the toner hopper 6 is stirred and mixed with the developer 7 by the rotation of the blades 12*a* accompanying with the rotation of the stirrer 12, to be transferred to the transferring screw 14 adjacent to the stirrer 12.

Each of the screws 13 and 14 is provided with a spiral blade around the axis of rotation throughout its entire length whereby the developer 7 in the circulating chamber 1 is transferred to the axial direction in accordance with the rotation of the respective screws 13 and 14. The transferring screws 13 and 14 are separated by a partition 15 so as to be protected against collision, and are rotated in opposite directions as indicated by the arrows in FIG. 1, thereby transferring the developer 7 in opposite directions in the axial direction. The developer 7 in the circulating chamber 1 is transferred to one direction along the longitudinal direction of the developing roller 5 by the rotation of the adjacent transferring screw 13, and is transferred to the transferring screw 14 at the tail end of the transferring route, whereby the developer 7 is transferred in the opposite direction by the rotation of the transferring screw 14. Further, the developer 7 is transferred to the transferring screw 13 at the tail end of the transferring route so as to be circulated in the circulating chamber 1.

The developer 7 consists substantially of a carrier of magnetic particles and a toner content adhering to the surface of the carrier. While the developer 7 is transferred by the screw 13, the developer 7 is caught on the outer cylinder of the developing roller 5 by the magnetic force of the fixed magnets inside the developing roller 5. The toner T caught on the surface of the roller 5 is kept in the state of adhering according to the operation of a magnetic field formed in the peripheral direction by the plurality of fixed magnets during rotation of the cylinder. The developer 7 carried in this way makes the toner T adhere to the electrostatic latent image formed on the peripheral surface of the drum 10 according to the static electricity, at the facing position to the drum 10 thereby enabling the latent image to become visible. The developer 7 remaining on the developing roller 5 and the carrier without the toner T are scraped away by a scraper 16 slidably contacting to the outer cylinder at the downstream side of the rotating direction, to be returned to the circulating chamber 1.

The developer 7 whose toner concentration has been lowered through the aforementioned developing process, is transferred to the other screw 14, at the tail end of the screw 13, and mixed with the toner T supplied from the toner hopper 6 according to the rotation of the stirrer 12 while it is transferred by the rotation of the screw 14 in the opposite direction. Thus the developer 7 which has regained an adequate toner concentration is returned to the transferring screw 13 to be used again.

FIG. 2 is a view explaining the operation of stirring the tonor T and the developer 7. As aforementioned, the stirrer 12 has the blades 12*a* projecting radially and the blades 12 scoop the developer 7 in an area of the upward rotation (in the left-hand half of the stirrer 12 in the figure). The toner T supplied from the toner hopper 6 onto the stirrer 12 is introduced into a sphere of the downward rotation (in the right-hand half of the stirrer 12 in the figure), and then is led to the transferring screw 14 by the rotation of the stirrer 12. Aforementioned operation is repeated thereby the toner T and the developer 7 is stirred.

The toner T and developer 7 are finely stirred in a case where the toner T is supplied from the hopper onto the stirrer 12, especially onto the sphere of the downward rotation.

However, since the toner is made of fine resin particles, it tends to disperse in all directions when it is dropped onto the stirrer 12 from the outlet 60, and part of it directly reaches the screw 14 without passing through the stirrer 12. The screw 14 transfers the developer 7 by the screw blade provided at the outer periphery thereof.

Since the toner T dropped onto the screw 14 is not sufficiently stirred, it is transferred with mixture without adhering to the carriers. It is feared that the toner T is caught by the developing roller 5 by way of the screw 13, it tends to become lumps. When the toner lumps adhere to the photosensitive drum 10 and the transferring is carried out onto a transfer paper, the image obtained through fixing process soils, that is, the quality of image appearing on paper is spoiled.

The same problem also arises even when the toner T is rightly supplied onto the stirrer 12 from the hopper 6. Since the toner T and developer 7 are stirred by introducing the toner T into the developer 7 scooped by the upward rotation of the blades 12*a*, for example, when an amount of the scooped developer 7 is insufficient to an amount of the supplied toner T, the toner not adhering to the carrier (hereafter to be called raw toner) is remained. When this raw toner is thrusted aside the screw 14 and transferred in accordance with the rotation of the screw 14, the quality of an image is spoiled as same as aforementioned case.

A further problem arises if the developer 7 is scooped by the blades 12*a*. The rotation of the blades 12*a* causes a centri-fugal action, thereby a part of the developer 7 gets on the blades 12*a* at the sphere of the upward rotation and disperses away from the stirrer 12 during the movement to the downward rotation. This dispersion reduces the amount of toner at the downward rotation sphere where the toner T is taken in. This is another cause of spoiling the quality of image causing raw toner. In order to prevent it, it may be one way to slow down the rotation of the stirrer 12 but the slow speed weakens the stirring force, therefore the raw toner remains by an inadequate mixing of the toner and developer.

SUMMARY OF THE INVENTION

The present invention has been devised to solve the above problems. An object of the invention is to provide a developing device and an image forming apparatus provided therewith which can avoid generation of the raw toner, thereby securing a good quality image formation free from toner lumps.

According to one aspect of the present invention, there is provided a developing device and an image forming apparatus, provided therewith including a dispersion-preventing plate provided in an outlet of a toner hopper and extending toward a stirrer. Therefore it can be prevented that toner out of the outlet disperses toward a screw means adjacent to the stirrer. It results to reduce raw toner in developer to be transferred to the screw means along the stirrer, and prevent the quality of an image spoiling due to raw toner transferred to a developing roller and further a photosensitive drum.

According to another aspect of the invention, there is provided a developing device and an image forming apparatus, including blades radially provided on its rotary axis and spiral screws such that they are alternately arranged in the axis direction. Therefore developer circulating in a circulating chamber is sent to the blades by the operation of the spiral screws. It results that a sufficient amount of developer is secured in the supplying position of tonor and the tonor supplied is stirred with the sufficient amount of developer. Consequently it reduces raw toner in the developer after stirring and prevents the quality of an image spoiling.

According to further another aspect of the invention, there is provided a developing device and an image apparatus, comprising the abovementioned dispersion-preventing plate and stirrer together. Consequently it avoids effectively generation of raw toner in accordance with their synergism and can enhance the quality of an image.

In case the lower end of the plate is in the developer between the stirrer and screw means, it divides the upper sphere between them, thereby effectively preventing the toner supplied from the outlet from dispersing toward the screw means.

In case a partition stuck on the bottom of the circulating chamber divides said sphere while allowing a sphere at each end thereof for communication, the toner supplied to the stirrer is stirred with the developer by a plurality of blades without extending to the screw means on the way along the stirrer and then sent to the screw means through the communication sphere of one end of the partition. It results to prevent raw toner generating through lack of stirring and further reduce the raw toner in the developer after stirring. Moreover in case the partition is integrated with the dispersion-preventing plate, the above operation is attained by easy construction.

When the transferring direction of the developer by the stirrer is opposite to that by the screw means adjacent the stirrer, the developer extending outward in accordance with transferring by the screw means is caught by the spiral screws and sent to the stirring position of blades with a sufficient amount. It results to reduce the raw toner in the developer after stirring.

In case the outlet is aligned to the blade the toner through the outlet is supplied upon the blade and stirred securely with the developer. Therefore raw toner in the developer is reduced much more and the quality of the image is improved.

The above and further objects and features of the present invention will more fully be apparent from the following detailed description with accompanying drawings.

DESCRIPTION OF THE PREFERRED EMBODIMENTS

Embodiment 1

Figure 1:
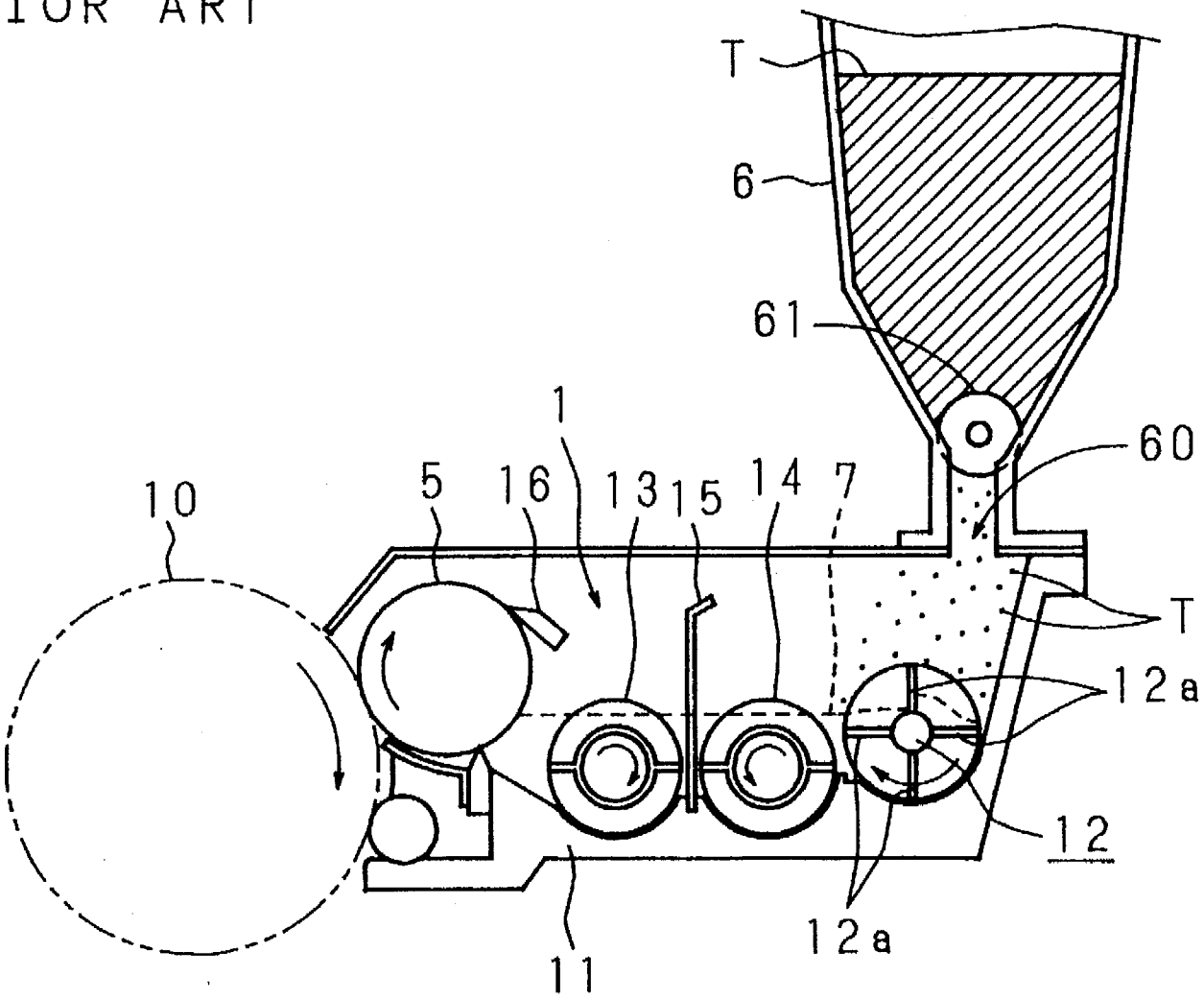
FIG. 1 PRIOR ART
FIG. 1 is a sectional side view showing a conventional developing device.
Figure 2:
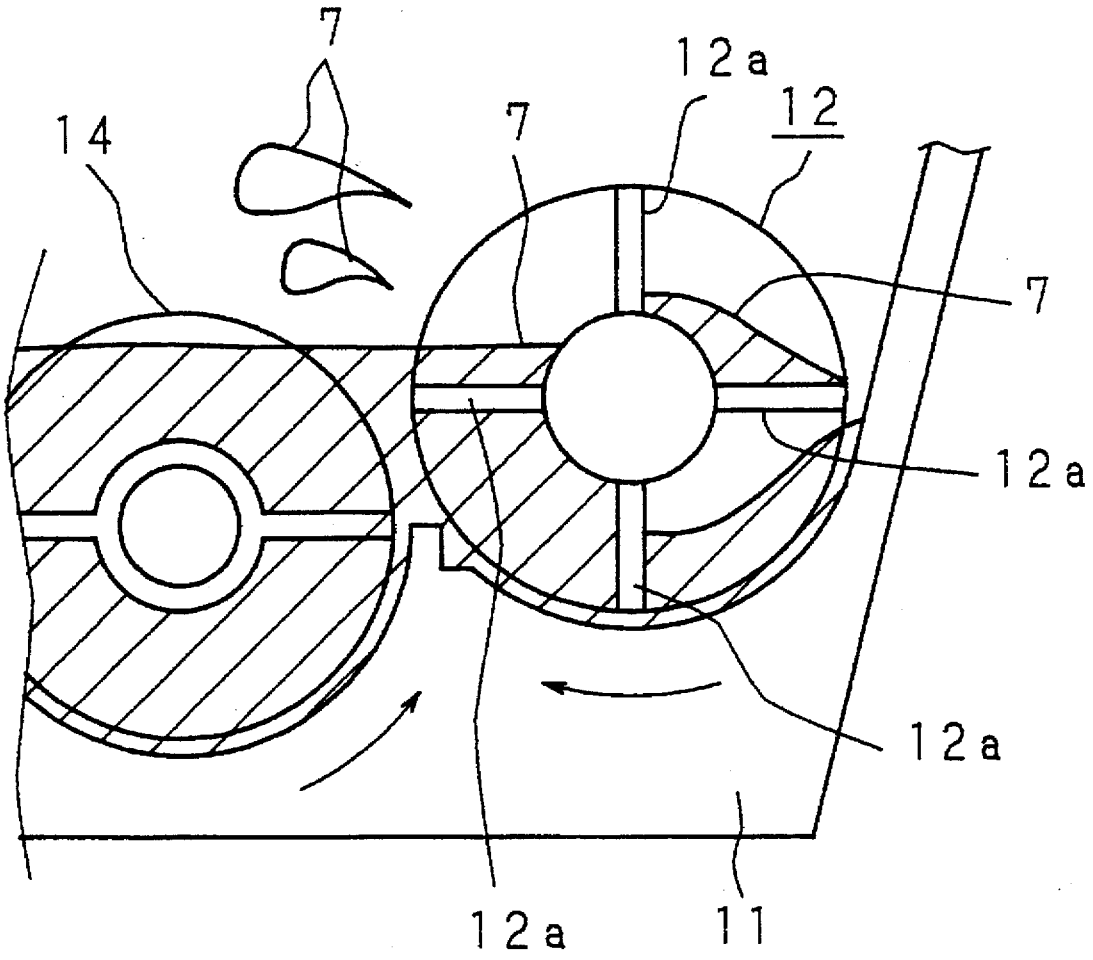
FIG. 2 PRIOR ART
FIG. 2 is an explanatory view exemplifying the stirring operation by the conventional developing device.
Figure 3:
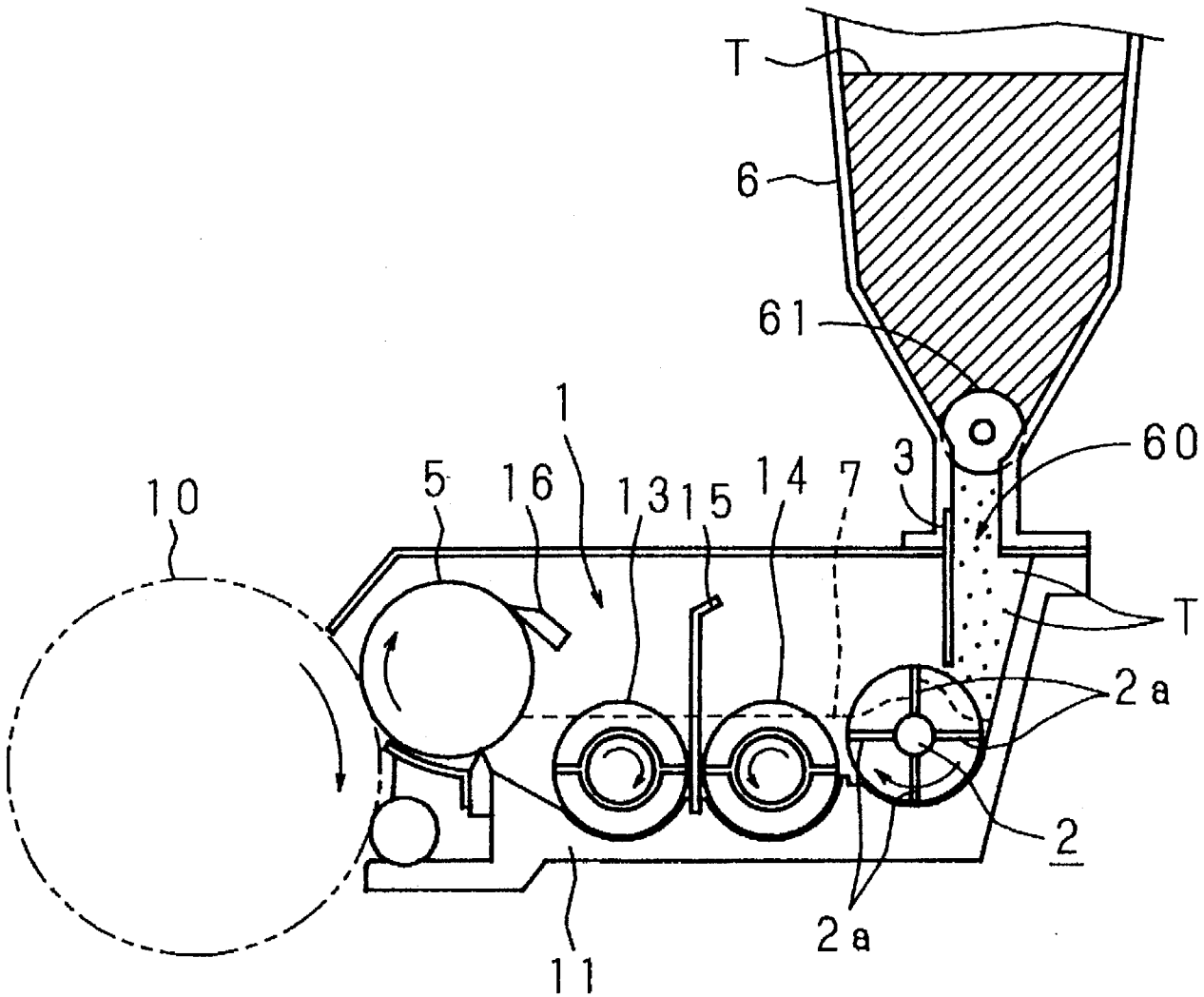
FIG. 3 is a sectional side view showing a first embodiment of the developing device according to the present invention.
Figure 4:
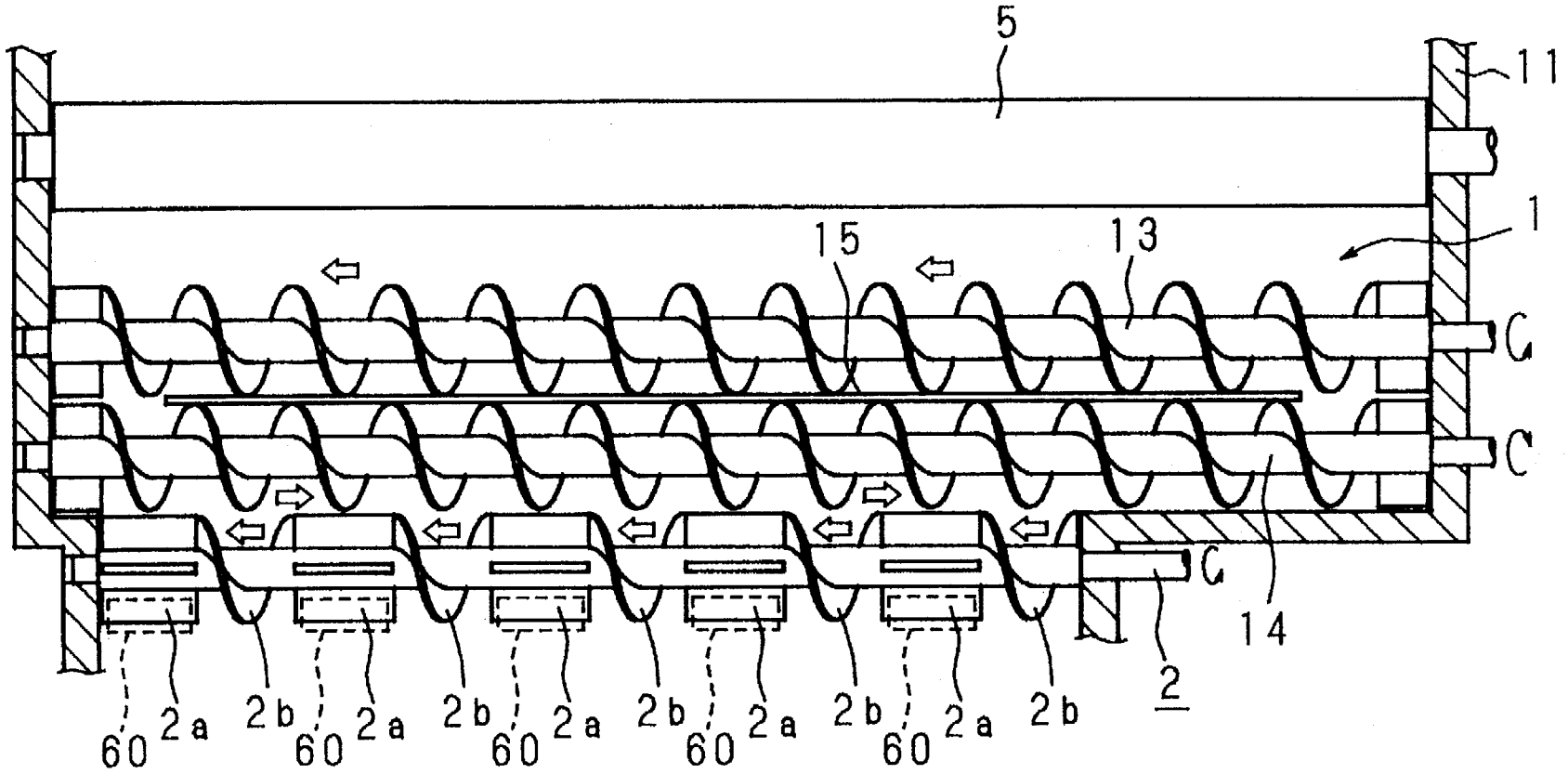
FIG. 4 is a plan view showing essential parts of the developing device shown in FIG. 3.

In the following, the invention will be described referring to the drawings showing the embodiments thereof. In FIGS. 3 and 4, the same reference numerals designate the same components and elements to those shown in FIGS. 1 and 2. In the developing device, one side of a housing 11 faces to an outer periphery of a photosensitive drum 10 shown by two-dot chain line, and a toner hopper 6 is provided in an upper portion of another side of the housing 11. Inside of the housing 11 is provided a circulating chamber 1. The developing device and the photosensitive drum 10 constitute an image forming apparatus. Around the periphery of the drum 10, a charging section, an exposing section, a transferring section and a cleaning section are respectively provided, however, the illustration and description are omitted since these devices are well-known.

The circulating chamber 1 houses a developing roller 5 whose one side is adjacent to and faces to the peripheral surface of the drum 10. A pair of transferring screws 13 and 14 are provided at the other side of the developing roller 5. Each of the roller 5 and the screws 13, 14 has its own axis parallel to the axis of the drum 10, and is driven to rotate in the directions indicated by the arrows shown in FIG. 3. The roller 5 and screw 13 are driven to rotate in the same direction as the drum 10, and the screw 14 in the opposite direction.

Each of the screws 13 and 14 is provided with a spiral blade along the entire length of the axis of rotation as shown in FIG. 4. The spiral blades have the same roll direction. The screws 13 and 14 are separated by a partition 15 forming a communicating section at its both ends. Thereby, the developer 7 is enable to flow axially by the rotation of the screw 13 along the developing roller 5, and is transferred to the screw 14 at one end of the partition 15. Then the developer 7 is transferred in the opposite direction in accordance with the rotation of the screw 14. When it reaches the other end of the partition 15, the developer 7 is again transferred by the screw 13. In this way the developer 7 is circulated in the chamber 1.

The toner hopper 6 is provided with an outlet 60 opening downward in the housing 11, and a supply roller 61 in the outlet 60. The supply roller 61 is a sponge roller rotationally driven around the horizontal axis. The toner T housed in the toner hopper 6 is drawn dose by dose from the outlet 60 into the housing 11 in company with the rotation of the supply roller 61. There is provided a stirrer 2 under the outlet 60 of the toner hopper 6. The stirrer 2 includes blades **2*a* and spiral screws 2*b* which are arranged alternately along the entire length of the axis as shown in FIG. 4. The transferring screws 13 and 14 and the stirrer 2 are rotated in the same directions as the drum 10 around the axis parallel to those of screws 13 and 14. The toner T supplied from the outlet 60 is stirred and mixed with the developer 7 and transferred to the adjacent transferring screw 14 by the stirrer 2**.

The blades **2*a* are plate-like blades and the number thereof is plural; in the illustrated embodiment, four blades are provided. The spiral screws 2*b* are arranged around the outer periphery of the axis of rotation in the spiral state, as shown in FIG. 4. The spiral screws 2*b* are wound in the same direction as that of the screw 14 but are rotated in the opposite direction to the screw 14, thereby enabling the developer 7 to move in the opposite direction to the screw 14 as indicated by the white thick arrows in FIG. 4**.

The outlet 60 is open only at the place where it interfaces with the blades **2*a* of the stirrer 2 which is at the lower side thereof, as shown by broken lines in FIG. 4. At the outlet 60, a dispersion block plate 3, which is characteristic to the invention, is provided. The dispersion block plate 3 is fixed to the front side wall of the outlet 60 at its upper end with its lower end being suspended downward. The lower edge as the extended end of the dispersion block plate 3 is made to face to the downward rotation sphere (right half portion in FIG. 3) of the blades 2*a***.

The developing roller 5 is a magnetic roller which consists essentially of a non-magnetic outer cylinder and a plurality of stationary magnets inside and along the periphery of the outer cylinder. The developer 7 to be transferred along the developing roller 5 by the rotation of the screw 13 is obtained by making the toner T adhere to the outside of the carrier consisting of magnetic particles. The developer is attracted to the outer cylinder of the developing roller 5 according to the magnetic force of the stationary magnets during the aforementioned conveyance and conveyed to the peripheral direction according to the rotation of the developing roller 5. The toner T of the developer 7 adheres to the surface of the drum 10 according to the static electricity, thereby enabling the electrostatic latent image to become visible. At this stage, the developer 7 remaining on the roller 5 and the carrier which lost the toner T are scraped by a scraper 16 provided at a downstream side of the rotational direction, returned to the circulating chamber 1, and then circulated.

As the toner T moves to the drum 10 with developing, the concentration of the toner T in the developer 7 reduces during conveyance by the screw 13. While the developer 7 is transferred in the opposite direction by the screw 14, it is refreshed with a fresh dose of toner T from the hopper 6 by the help of the stirrer 2, thereby restoring the concentration. The developer 7 whose toner concentration restored returns to the screw 13 for reuse.

The developer 7 and the fresh toner T from the hopper 6 are stirred and mixed with each other in accordance with the rotation of the stirrer 2. More specifically, the blades **2*a* scoop the developer 7 transferred by the screw 14, and mix it with the fresh dose of toner T. The spiral screws 2*b* of the stirrer 2 send the developer 7 to the blades 2*a* neighboring to each other and located downstream side of each spiral screw 2*b***.

In the sphere of the downward rotation of the blade **2*a* where the developer 7 and toner 7 are stirred, there are the developer 7 taken in by the rotation of the blade 2*a* and the developer 7 sent by the spiral screw 2*b* adjacent to the blade 2*a*. In this way the toner T is stirred with the sufficient quantity of the developer 7. In the result the "raw toner" in the developer 7 reduces, it is prevented that the "raw toner" is transferred to the place where it contacts developing roller 5**.

As shown in FIG. 4, since the outlet 60 of the hopper 6 is aligned with the blades **2*a* of the stirrer 2, ensuring that each fresh dose of toner T is dropped onto the blades 2*a* where the toner 7 is stirred with the developer 7**, thereby the "raw toner" reduces.

Since the spiral screw **2*b* of the stirrer 2 has, as aforementioned, an opposite advancing direction to that of the transferring screw 14, the developer 7 is effectively taken in. More particularly, while the developer 7 is transferred by the screw 14, it tends to spread with respect to its advancing direction, however, since the spreading of the developer 7 is prevented at the partition 15 side, the developer spreads at the stirrer 2 side. The developer 7 is taken in by the spiral screws 2*b*** against the spreading, a sufficient quantity of developer 7 is sent to the blades 2*a*. When the developer 7 and toner 7 are stirred, the "raw toner" reduces.

As described above, the dispersion block plate 3 is extended to a point adjacent to the stirring blades 2*a* of the stirrer 2 from the outlet 60 so as to prevent the toner dropped from the outlet 60 from dispersing toward the screw 14. Consequently the toner T concentratedly drops onto the stirrer 2 and is rapidly taken in the developer 7 so that they are stirred. Therefore the whole toner T supplied is sent to the screw 14 through stirring by the stirrer 2, it avoids that the "raw toner" is supplied to the place where the toner T contacts with the roller 5.

Embodiment 2

Figure 5:
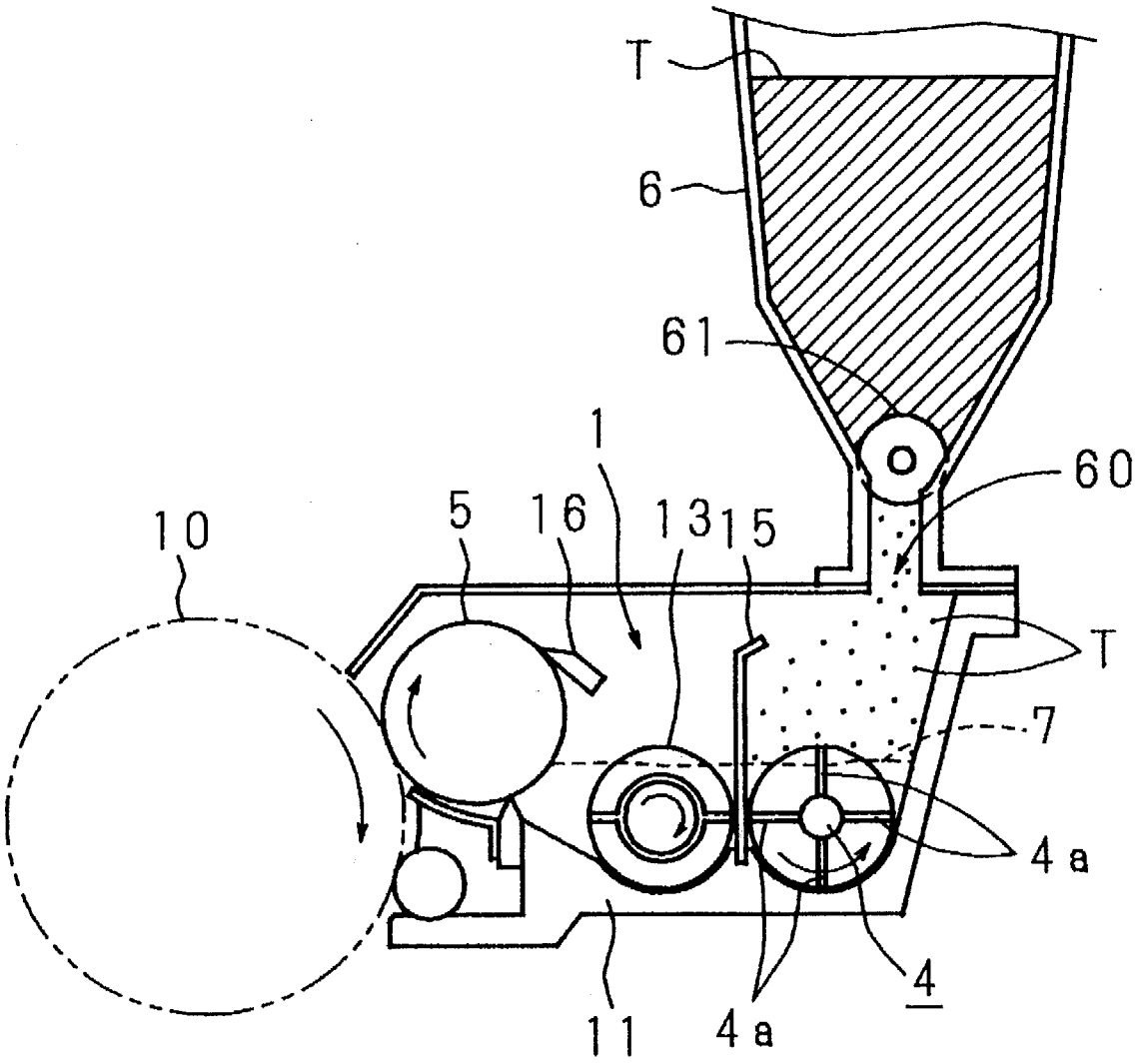
FIG. 5 is a sectional side view showing a second embodiment of the developing device according to the present invention.
Figure 6:
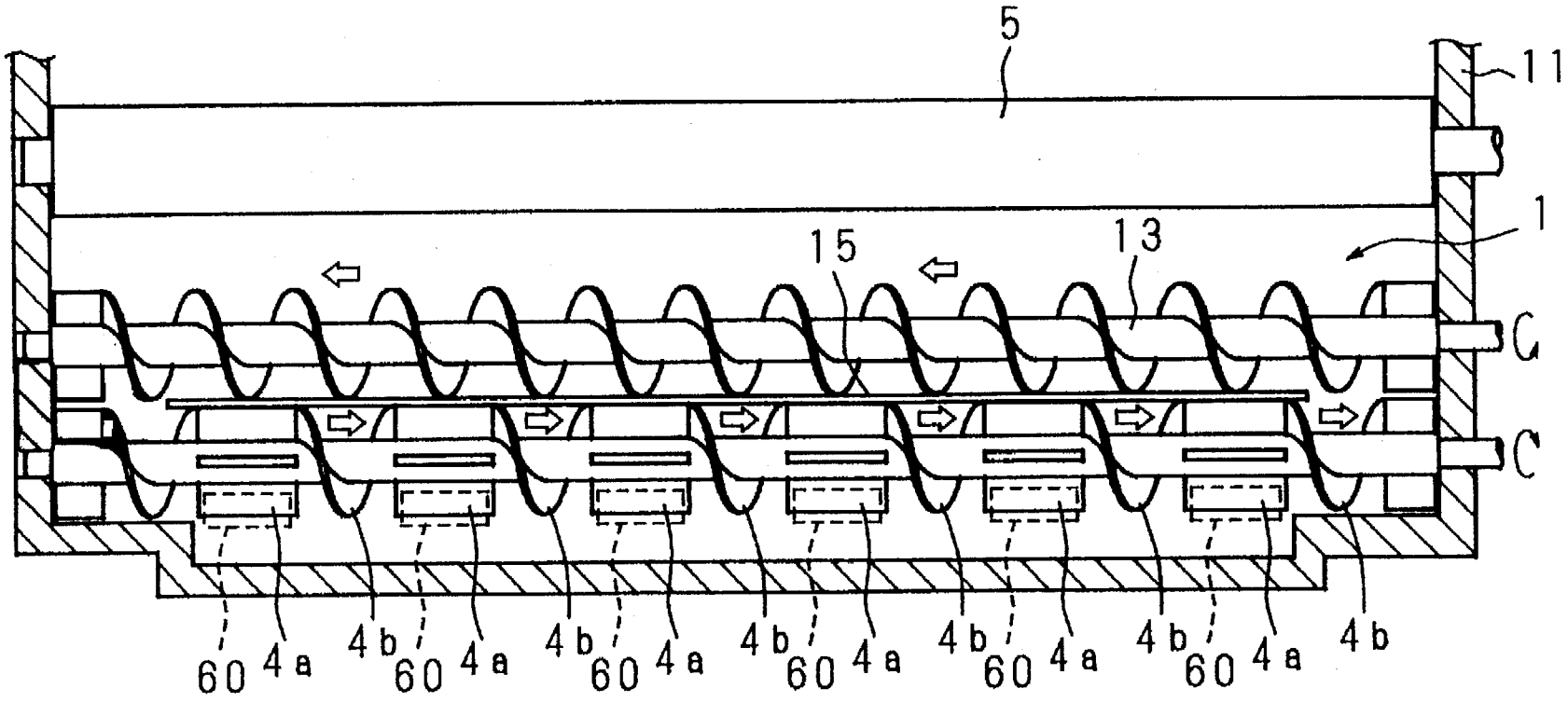
FIG. 6 is a plan view showing essential parts of the developing device shown in FIG. 5.

Referring to FIGS. 5 and 6, a second embodiment will be described in which the same reference numerals designate the same components shown in FIGS. 1 to 4:

A transferring screw 13 and a stirrer 4 are provided in a developer circulating chamber 1 located at one side of a developing roller 5. The stirrer 4 includes stirring blades 4*a* and a spiral screw 4*b* alternately over the entire length of the axis. The stirrer 4 is obtained by incorporating the transferring screw 14 and the stirrer 2 shown in FIG. 3 and FIG. 4.

A toner hopper 6 is provided with outlets 60 at the place where they interface the blades 4*a* of the stirrer 4. Consequently the toner supplied from the hopper 6 directly drops onto the blades 4*a*.

The screw 13 transfers developer 7 along the developing roller 5 in the circulating chamber 1, and passes it on to the stirrer 4 where the screw 4*b* transfers the developer 7 in an opposite direction and the blades 4*b* mix it with a fresh dose of toner T from the hopper 6. In this way the developer 7 is supplemented with the fresh toner, and does not include "raw toner". Accordingly there is hardly fear that the "raw toner" is caught by the roller 5.

A developing device according to the embodiment 2 can have a relatively small size owing to small number of components, because one stirrer 4 transfers the developer 7 and mixes the developer 7 and the toner T. In the embodiment 2, it is required that the stirrer 4 is rotated at a higher speed than the transferring screw 13, and the blades 4*b* have a larger pitch or a larger diameter than those of the transferring screw 13 so as to achieve the same transferring power as that possessed by the transferring screw 13.

Embodiment 3

Figure 7:
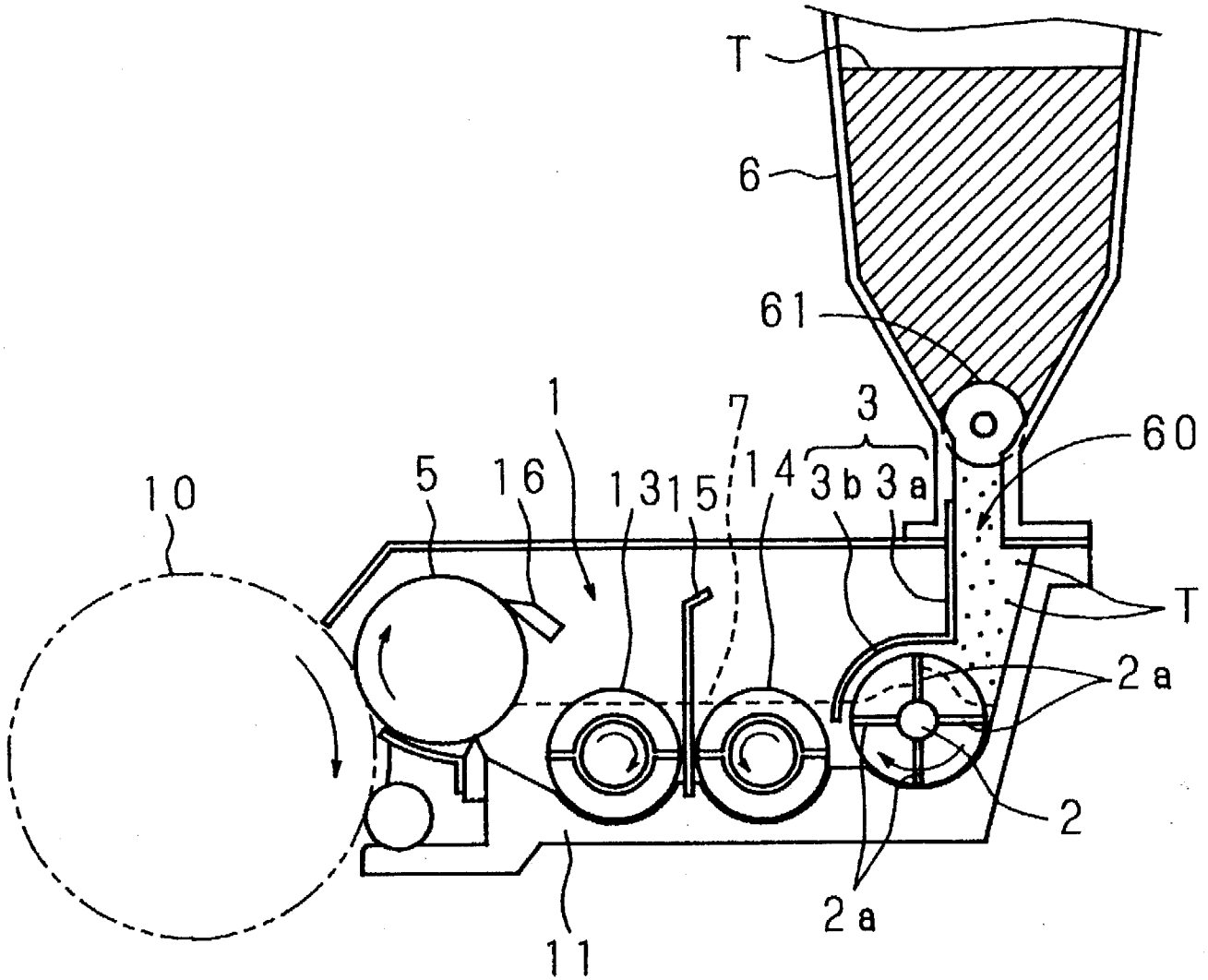
FIG. 7 is a sectional side view showing a third embodiment of the developing device according to the present invention.
Figure 8:
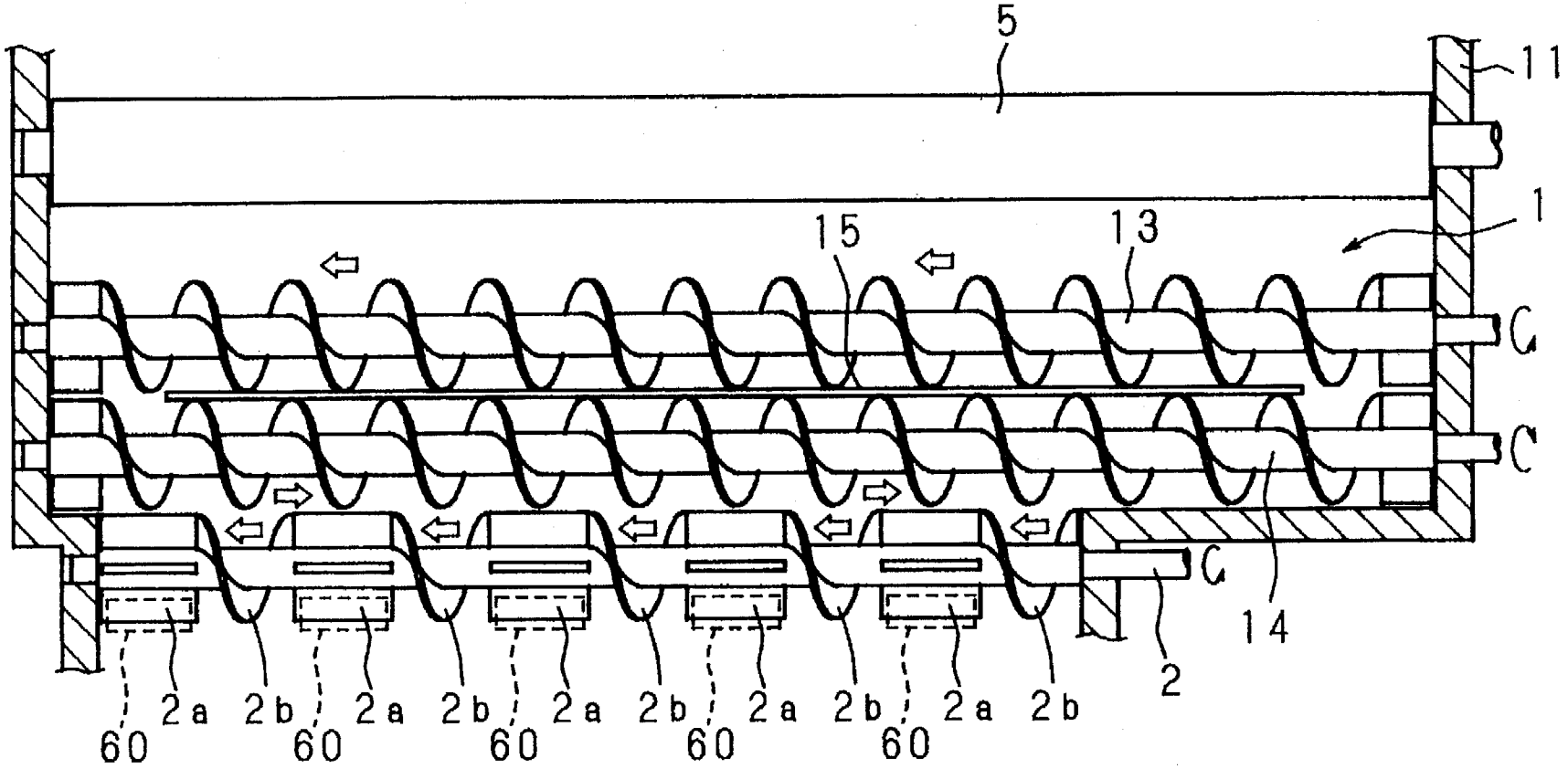
FIG. 8 is a plan view showing essential parts of the developing device shown in FIG. 7.

Referring to FIGS. 7 and 8, a third Embodiment will be described wherein the same reference numerals designate the same components shown in FIGS. 1 to 6:

This embodiment is a modification to the embodiment 2 shown in FIGS. 3 and 4, characterized by the provision of a dispersion block plate 3 for blocking the spreading of the toner T toward a screw 14. The plate 3 is fixed to the upper end at the front side of a toner hopper 6 and includes an upright portion 3*a* and an eaves portion 3*b*. The upright portion 3*a* is installed downward from the fixing portion and terminates immediately above the stirrer 2 as shown in FIG. 7, and the eaves portion 3*b* extends from the lowest end of the upright portion 3*a* forward to the stirrer 2 like a quarter circle until its edge is buried in the developer 7 staying in a space between the stirrer 2 and the transferring screw 14. Thus the top portion of the stirrer 2 is covered by the eaves portion 3*b*.

The dotted lines in FIG. 7 indicates a level represented by an normal amount of developer 7 circulating in the circulating chamber 1. When the plate 3 has such a size that the edge of the eaves 3*b* is under the normal level, the edge can be buried in the developer 7.

In this way the dispersion block plate 3 effectively guides the toner T from the hopper 6 to the stirrer 2 without dispersion toward the screw 14 thereby enabling a required amount of toner T to drop onto the blades 2*a*. Since the plate 3 covers the sphere from the outlet 60 to the normal level of the developer 7, the plate 3 can prevent completely the dispersion of the toner T and the toner T is sent to the screw 14 through sufficient mixture with the developer 7. This assures that no raw toner is transferred to the developing roller 5. The refreshed developer is then passed on to the transferring screw 14 under the edge of the eaves 3*b* of the plate 3.

Embodiment 4

Figure 9:
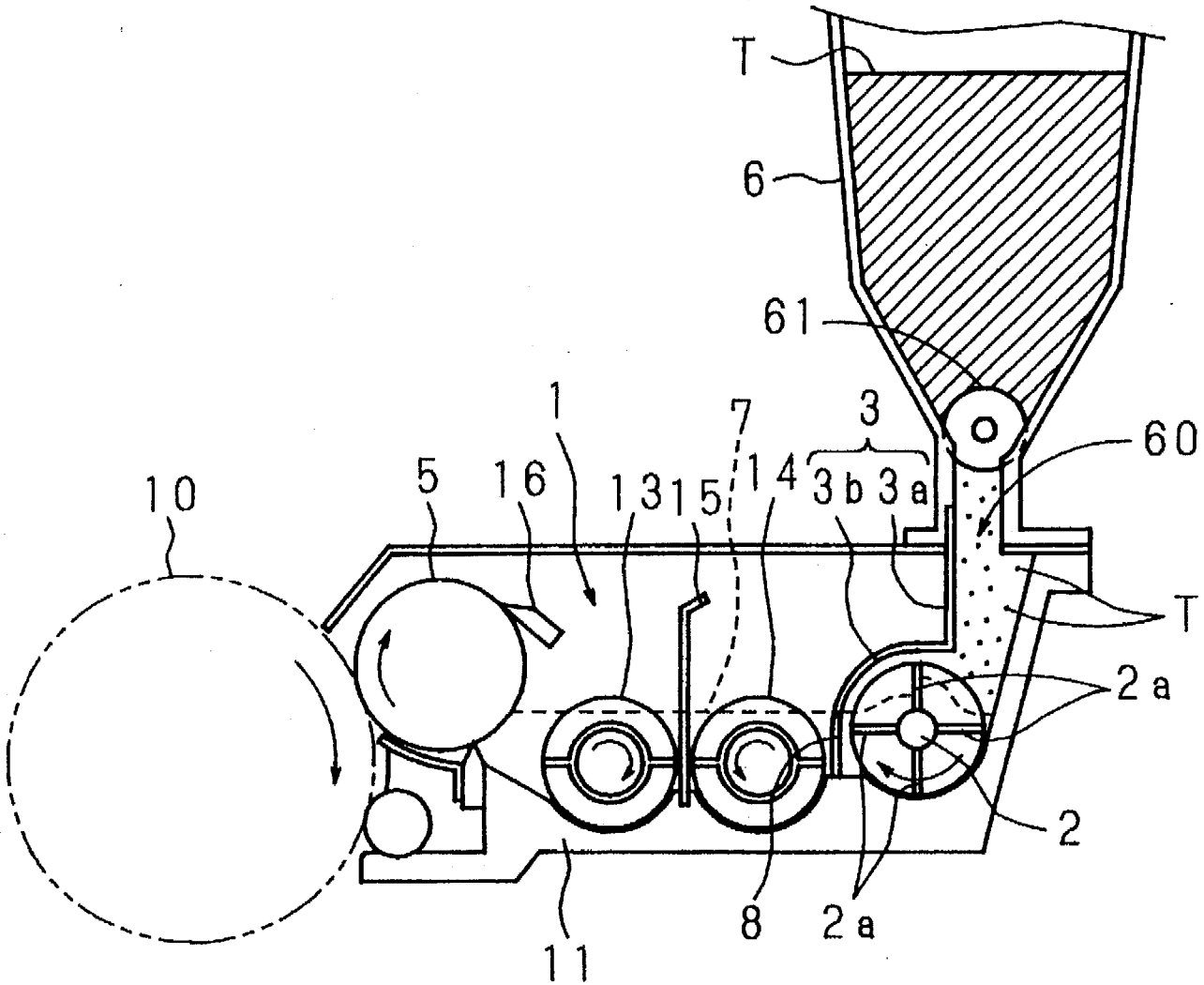
FIG. 9 is a sectional side view showing a fourth embodiment of the developing device according to the present invention.
Figure 10:
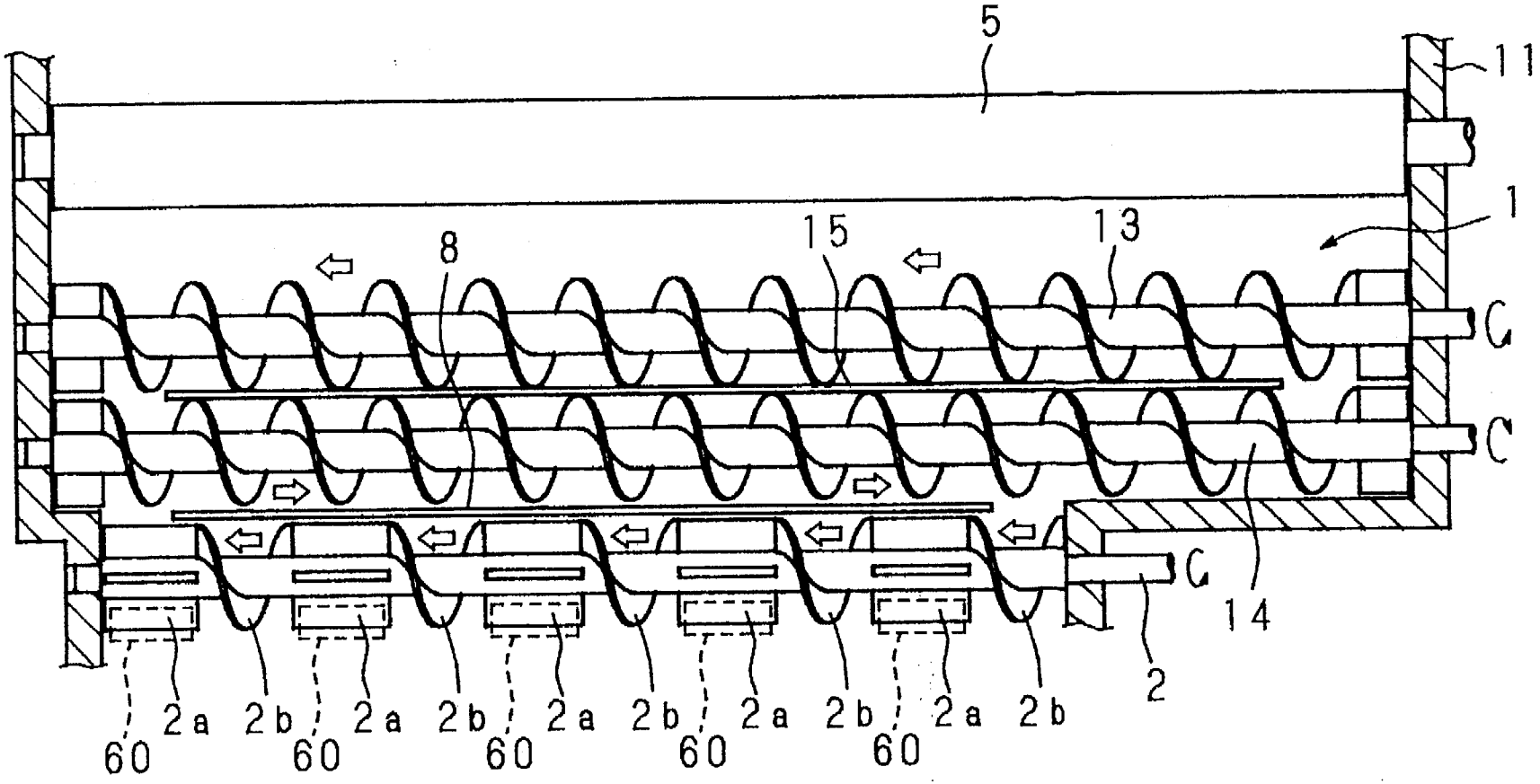
FIG. 10 is a plan view showing essential parts of the example shown in FIG. 9.

Referring to FIGS. 9 and 10, a fourth embodiment will be described wherein the same reference numerals designate the same components to those in FIGS. 3, 4, 7 and 8:

This embodiment is a modification to embodiments 1 and 3 shown in FIGS. 3–4 and 7–8, characterized by the configuration of a dispersion block plate 3 for blocking the dispersion of the toner T dropped from outlets 60 and a partition disposed between a stirrer 2 and a transferring screw 14. Unlike the dispersion block in the embodiment 3, the plate 3 has an upright portion and an eaves portion 3*b*. The edge of the eaves portion 3*b* is joined to an upper edge of a partition 8 which is a plate standing at the base of the housing 11. The partition 8 is disposed such that it divides the sphere between the stirrer 2 and screw 14 with allowing a sphere at each end thereof for communication.

In this construction the toner T dropped from outlets 60 of a toner hopper 60 onto the stirrer 2 concentratedly, without a dispersion toward the screw 14, by the help of the plate 3 which confines the sphere between the outlet and a normal level of the developer 7 closely. Since the partition 8 joined to the plate 3 is stuck in the developer 7 until it reaches the bottom of the circulating chamber 1, it prevents the toner T from dispersing in all directions while it is dropped onto the stirrer 2.

In this way a predetermined amount of toner T is supplied to the sphere of the stirrer 2 confined by the plate 3, which means that the supplied toner is sent to the rotation sphere of blade 2*a* adjacent to spiral screw 2*b* in the downstream by the rotation of the spiral screw 2*b* with the developer 7 sent through the communication sphere disposed at one end of the partition 8. The toner T and developer 7 are sufficiently stirred by the blades 2*a* and sent to the screw 14 through the communication sphere disposed at the other end of the partition 8. It results that it can be effectively prevented that "raw toner" is generated causing insufficient stirring.

The partition 8 may not be integrated with the dispersion block plate 3. The invention includes the construction such that they are separately prepared and such that only the partition 8 is prepared. The partition 15 shown in FIG. 5 according to the embodiment 2 is disposed between the stirrer 4 having same operation as that of the stirrer 2 and the transferring screw 13, confines the sphere with allowing a sphere at each end thereof for communication, thereby having same operation as that of the partition 8 also.

As this invention may be embodied in several forms without departing from the spirits of essential characteristics thereof, the present embodiment is therefore illustrative and not restrictive, since the scope of the invention is defined by the appended claims rather than by the description preceding them, and all changes that fall within the metes and bounds of the claims, or equivalence of such metes and bounds thereof are therefore intended to be embraced by the claims.

What is claimed is:

1. A developing device, comprising:

a toner hopper for storing toner, the toner hopper having an outlet through which the toner stored therein is discharged;

a stirrer for mixing and transferring the toner from the hopper with developer including magnetic particles, and which is provided with blades radially provided on its rotary axis and spiral screws alternately in the axis direction;

a screw means for transferring the developer from the stirrer in accordance with the rotation thereof and along the rotary axis thereof, the screw means being located adjacent to said stirrer;

a developing roller adjacent to said screw means, the developing roller comprising an outer cylinder and inner magnets which magnetically attract a toner content of the developer on the surface of the outer cylinder transferred from said screw means;

a circulating chamber for allowing the developer to circulate from said stirrer to said developing roller by way of said screw means; and a dispersion-preventing plate including a plate-like upright portion suspended from the outlet of the toner hopper, and a cover portion connected with a lower end of said upright portion, said cover portion having a shape of a part of a cylinder for covering a part of the stirrer.

2. The developing device according to claim 1, wherein the lower end of said dispersion-preventing plate is buried in the developer between said stirrer and said screw means.

3. The developing device according to claim 2, further comprising a partition which is stuck on the bottom of said circulating chamber and divides the area between said stirrer and said screw means with allowing an area at each end thereof for communication.

4. The developing device according to claim 3, wherein said partition is connected with said dispersion-preventing plate.

5. The developing device according to claim 4, wherein said outlet of the toner hopper is aligned with blades of the stirrer.

6. The developing device according to claim 3, wherein said outlet of the toner hopper is aligned with blades of the stirrer.

7. The developing device according to claim 2, wherein said spiral screws of said stirrer are provided with an opposite screw turn to that of said screw means adjacent thereto.

8. The developing device according to claim 7, wherein said outlet of the toner hopper is aligned with said blades of the stirrer.

9. The developing device according to claim 2, wherein said outlet of the toner hopper is aligned with said blades of the stirrer.

10. The developing device according to claim 1, wherein the lower end of said dispersion-preventing plate is buried in the developer between the stirrer and the screw means.

11. The developing device according to claim 10, further comprising a partition which is stuck on the bottom of said circulating chamber and divides the area between said stirrer and said screw means with allowing an area at each end thereof for communication.

12. The developing device according to claim 11, wherein said partition is connected with said dispersion-preventing plate.

13. The developing device according to claim 12, wherein said outlet of the toner hopper is aligned with said blades of the stirrer.

14. The developing device according to claim 11, wherein said outlet of the toner hopper is aligned with said blades of the stirrer.

15. The developing device according to claim 10, wherein said spiral screws of said stirrer are provided with an opposite screw turn to that of said screw means adjacent thereto.

16. The developing device according to claim 15, wherein said outlet of the toner hopper is aligned with said blades of the stirrer.

17. The developing device according to claim 10, wherein said outlet of the toner hopper is aligned with said blades of the stirrer.

18. The developing device according to claim 1, further comprising a partition which is stuck on the bottom of said circulating chamber and divides the area between said stirrer and said screw means with allowing an area at each end thereof for communication.

19. The developing device according to claim 18, wherein said partition is connected with said dispersion-preventing plate.

20. The developing device according to claim 19, wherein said outlet of the toner hopper is aligned with blades of the stirrer.

21. The developing device according to claim 18, wherein said outlet of the toner hopper is aligned with blades of the stirrer.

22. The developing device according to claim 1, further comprising a partition which is stuck on the bottom of said circulating chamber and divides the area between said stirrer and said screw means with allowing an area at each end thereof for communication.

23. The developing device according to claim 22, wherein said partition is connected with said dispersion-preventing plate.

24. The developing device according to claim 23, wherein said outlet of the toner hopper is aligned with said blades of the stirrer.

25. The developing device according to claim 22, wherein said outlet of the toner hopper is aligned with said blades of the stirrer.

26. The developing device according to claim 1, wherein said spiral screws of said stirrer are provided with an opposite screw turn to that of said screw means adjacent thereto.

27. The developing device according to claim 26, wherein said outlet of the toner hopper is aligned with said blades of the stirrer.

28. The developing device according to claim 1, wherein said outlet of the toner hopper is aligned with said blades of the stirrer.

29. An image forming apparatus comprising:

a toner hopper for storing toner, the toner hopper having an outlet through which the toner stored therein is discharged;

a stirrer for mixing and transferring the toner from the hopper with developer including magnetic particles and which is provided with blades radially provided on its rotary axis and spiral screws alternately in the axis direction;

a screw means for transferring the developer from the stirrer in accordance with the rotation thereof along the rotary axis thereof, the screw means being located adjacent to said stirrer;

a developing roller adjacent to said screw means, the developing roller comprising an outer cylinder and inner magnets which magnetically attract a toner content of the developer on the surface of the outer cylinder transferred from said screw means;

a circulating chamber for allowing the developer to circulate from said stirrer to said developing roller by way of said screw means; and a dispersion-preventing plate including a plate-like upright portion suspended from the outlet of the toner hopper, and a cover portion connected with a lower end of said upright portion, said cover portion having a shape of a part of a cylinder for covering a part of the stirrer; and a photosensitive drum provided adjacent to said developing roller so as to allow a latent image thereon to become visible upon exposure to the toner on the developing roller.

30. The image forming apparatus according to claim 29, wherein the lower end of said dispersion-preventing plate is buried in the developer between said stirrer and said screw means.

31. The image forming apparatus according to claim 30, further comprising a partition which is stuck on the bottom of said circulating chamber and divides the area between said stirrer and said screw means with allowing an area at each end thereof for communication.

32. The image forming apparatus according to claim 31, wherein said partition is connected with said dispersion-preventing plate.

33. The image forming apparatus according to claim 32, wherein said outlet of the toner hopper is aligned with said blades of the stirrer.

34. The image forming apparatus according to claim 31, wherein said outlet of the toner hopper is aligned with blades of the stirrer.

35. The image forming apparatus according to claim 30, wherein said spiral screws of said stirrer are provided with an opposite screw turn to that of said screw means adjacent thereto.

36. The image forming apparatus according to claim 35, wherein said outlet of the toner hopper is aligned with said blades of the stirrer.

37. The image forming apparatus according to claim 30, wherein said outlet of the toner hopper is aligned with said blades of the stirrer.

38. The image forming apparatus according to claim 29, wherein the lower end of said dispersion-preventing plate is buried in the developer between the stirrer and the screw means.

39. The image forming apparatus according to claim 38, further comprising a partition which is stuck on the bottom of said circulating chamber and divides the area between said stirrer and said screw means with allowing an area at each end thereof for communication.

40. The image forming apparatus according to claim 39, wherein said partition is connected with said dispersion-preventing plate.

41. The image forming apparatus according to claim 40, wherein said outlet of the toner hopper is aligned with said blades of the stirrer.

42. The image forming apparatus according to claim 39, wherein said outlet of the toner hopper is aligned with said blades of the stirrer.

43. The image forming apparatus according to claim 38, wherein said spiral screws of said stirrer are provided with an opposite screw turn to that of said screw means adjacent thereto.

44. The image forming apparatus according to claim 43, wherein said outlet of the toner hopper is aligned with said blades of the stirrer.

45. The image forming apparatus according to claim 38, wherein said outlet of the toner hopper is aligned with said blades of the stirrer.

46. The image forming apparatus according to claim 29, further comprising a partition which is stuck on the bottom of said circulating chamber and divides the area between said stirrer and said screw means with allowing an area at each end thereof for communication.

47. The image forming apparatus according to claim 46, wherein said partition is connected with said dispersion-preventing plate.

48. The image forming apparatus according to claim 47, wherein said outlet of the toner hopper is aligned with said blades of the stirrer.

49. The image forming apparatus according to claim 46, wherein said outlet of the toner hopper is aligned with blades of the stirrer.

50. The image forming apparatus according to claim 29, further comprising a partition which is stuck on the bottom of said circulating chamber and divides the area between said stirrer and said screw means with allowing an area at each end thereof for communication.

51. The image forming apparatus according to claim 50, wherein said partition is connected with said dispersion-preventing plate.

52. The image forming apparatus according to claim 51, wherein said outlet of the toner hopper is aligned with said blades of the stirrer.

53. The image forming apparatus according to claim 50, wherein said outlet of the toner hopper is aligned with said blades of the stirrer.

54. The image forming apparatus according to claim 29, wherein said spiral screws of said stirrer are provided with an opposite screw turn to that of said screw means adjacent thereto.

55. The image forming apparatus according to claim 54, wherein said outlet of the toner hopper is aligned with said blades of the stirrer.

56. The image forming apparatus according to claim 29, wherein said outlet of the toner hopper is aligned with said blades of the stirrer.

* * * * *